US007628591B2

(12) United States Patent
Yoo et al.

(10) Patent No.: US 7,628,591 B2
(45) Date of Patent: Dec. 8, 2009

(54) APPARATUS AND METHOD FOR CONTROLLING OPERATION OF COMPRESSOR

(75) Inventors: Jae-Yoo Yoo, Gyeonggi-Do (KR); Chel-Woong Lee, Seoul (KR); Ji-Won Sung, Seoul (KR)

(73) Assignee: LG Electronics Inc., Seoul (KR)

( * ) Notice: Subject to any disclaimer, the term of this patent is extended or adjusted under 35 U.S.C. 154(b) by 711 days.

(21) Appl. No.: 11/032,142

(22) Filed: Jan. 11, 2005

(65) Prior Publication Data

US 2006/0056979 A1 Mar. 16, 2006

(30) Foreign Application Priority Data

Sep. 11, 2004 (KR) ..... 10-2004-0072826
Sep. 11, 2004 (KR) ..... 10-2004-0072827

(51) Int. Cl.
*F04B 49/06* (2006.01)
*F04B 35/04* (2006.01)

(52) U.S. Cl. ..... 417/417; 417/53; 417/44.11

(58) Field of Classification Search ..... None
See application file for complete search history.

(56) References Cited

U.S. PATENT DOCUMENTS 4,706,470 A * 11/1987 Akazawa et al. ..... 62/209
6,075,671 A * 6/2000 Yoneda et al. ..... 360/75
6,644,943 B1 11/2003 Lilie et al.
2003/0026702 A1* 2/2003 Yoo et al. ..... 417/44.11
2003/0143080 A1* 7/2003 Yoo et al. ..... 417/44.1

* cited by examiner

*Primary Examiner*—Devon C Kramer
*Assistant Examiner*—Philip Stimpert
(74) *Attorney, Agent, or Firm*—Birch, Stewart, Kolasch & Birch, LLP

(57) ABSTRACT

An apparatus for controlling a compressor includes a stroke calculator for calculating a stroke estimate value of a compressor based on a value of a current applied to a motor of the compressor and a value of a voltage applied to the motor of the compressor; an operation frequency reference determining unit for integrating the stroke estimate value to output an integrated stroke value, detecting a mechanical resonance frequency of the compressor based on the integrated stroke estimate value and the current value, and determining the detected mechanical resonance frequency as an operation frequency reference value; and a controller for varying a current operation frequency of the compressor according to the determined operation frequency reference value.

21 Claims, 6 Drawing Sheets

APPARATUS AND METHOD FOR CONTROLLING OPERATION OF COMPRESSOR

BACKGROUND OF THE INVENTION

1. Field of the Invention

The present invention relates to a compressor and, more particularly, to an apparatus and method for controlling an operation of a reciprocating compressor.

2. Description of the Prior Art

In general, a reciprocating compressor does not employ a crank shaft for converting a rotational motion into a linear motion, so it has higher compression efficiency than a general compressor.

When the reciprocating compressor is used for a refrigerator or an air-conditioner, a compression ratio of the reciprocating compressor can be varied by varying a stroke voltage inputted to the reciprocating compressor in order to control cooling capacity.

A conventional reciprocating compressor will now be described with reference to FIG. 1.

FIG. 1 is a block diagram showing the construction of an apparatus for controlling an operation of a reciprocating compressor in accordance with a prior art.

As shown in FIG. 1, a conventional apparatus for controlling an operation of a reciprocating compressor includes: a current detector 4 for detecting a current applied to a motor (not shown) of a reciprocating compressor 6; a voltage detector 3 for detecting a voltage applied to the motor; a stroke calculator 5 for calculating a stroke estimate value of the compressor based on the detected current and voltage values and a parameter of the motor; a comparator 1 for comparing the calculated stroke estimate value and a pre-set stroke reference value and outputting a different value according to the comparison result; and a stroke controller 2 for controlling an operation (stroke) of the compressor 6 by varying a voltage applied to the motor according to the difference value.

The apparatus for controlling an operation of the reciprocating compressor operates as follows.

First, the current detector 4 detects a current applied to the motor of the compressor 6 and outputs the detected current value to the stroke calculator 5. At this time, the voltage detector 3 detects a voltage applied to the motor and outputs the detected voltage value to the stroke calculator 5.

The stroke calculator 5 calculates a stroke estimate value (X) of the compressor by substituting the detected current and voltage values and a parameter of the motor to equation (1) shown below and applies the obtained stroke estimate value (X) to the comparator 1.

$$X = \frac{1}{\alpha}\int (V_M - Ri - L\dot{i})dt \tag{1}$$

wherein 'R' is a motor resistance value, 'L' is a motor inductance value, $\alpha$ is a motor constant value, $V_M$ is a value of a voltage applied to the motor, 'i' is a value of a current applied to the motor, and '$\dot{i}$' is a time change rate of the current applied to the motor. Namely, '$\dot{i}$' is a differentiated value of 'i' (di/dt).

The comparator 1 compares the stroke estimate value with the stroke reference value and applies a difference value according to the comparison result to the stroke controller 2.

The stroke controller 2 controls the stroke of the compressor 6 by varying a voltage applied to the motor of the compressor 6 based on the difference value. This will be described with reference to FIG. 2.

FIG. 2 is a flow chart of a method for controlling an operation of the reciprocating compressor in accordance with the prior art.

First, when the stroke calculate 5 applies the stroke estimate value to the comparator 1 (step S1), the comparator 1 compares the stroke estimate value with the pre-set stroke reference value (step S2) and outputs a difference value according to the comparison result to the stroke controller 2.

If the stroke estimate value is smaller than the stroke reference value, the stroke controller 2 increases a voltage applied to the motor to control the stroke of the compressor (step S3). If, however, the stroke estimate value is greater than the stroke reference value, the stroke controller 2 reduces the voltage applied to the motor (step S4).

Thus, in the conventional apparatus and method for controlling an operation of the reciprocating compressor, even though a mechanical resonance frequency of the compressor is varied because of the change in the voltage applied to the motor of the compressor based on the stroke estimate value an the stroke reference value, the reciprocating compressor is operated with the always same operation frequency, causing a problem that operation efficiency of the reciprocating compressor deteriorates.

A reciprocating compressor in accordance with a different embodiment of the present invention is disclosed in U.S. Pat. No. 6,644,943 registered on Nov. 11, 2003.

SUMMARY OF THE INVENTION

Therefore, an object of the present invention is to provide an apparatus and method for controlling an operation of a compressor capable of enhancing operation efficiency of a compressor even though a load of the compressor is changed.

To achieve these and other advantages and in accordance with the purpose of the present invention, as embodied and broadly described herein, there is provided an apparatus for controlling a compressor including: a stroke calculator for calculating a stroke estimate value of a compressor based on a value of a current applied to a motor of the compressor and a value of a voltage applied to the motor of the compressor; an operation frequency reference determining unit for integrating the stroke estimate value to output an integrated stroke value, detecting a mechanical resonance frequency of the compressor based on the integrated stroke estimate value and the current value, and determining the detected mechanical resonance frequency as an operation frequency reference value; and a controller for varying a current operation frequency of the compressor according to the determined operation frequency reference value.

To achieve the above object, there is also provided an apparatus for controlling an operation of a compressor including: a current detector for detecting a current applied to a motor of a compressor; a voltage detector for detecting a voltage applied to the motor; a stroke calculator for calculating a stroke estimate value of the compressor based on the detected current and voltage values and a parameter of the motor; an operation frequency reference value determining unit for integrating the stroke estimate value to output an integrated stroke value, detecting a mechanical resonance frequency of the compressor based on the integrated stroke estimate value and the detected current value, and determining the detected mechanical resonance frequency as an operation frequency reference value; a comparator for comparing the stroke estimate value outputted from the stroke calculator with a stroke reference value and outputting a difference value according to the comparison result; and a controller for controlling an operation of the compressor by varying a current operation frequency according to the determined operation frequency reference value and varying the voltage applied to the motor of the compressor according to the difference value outputted from the comparator.

To achieve the above object, there is also provided a method for controlling an operation of a compressor including: integrating a stroke estimate value of a compressor based on a value of a current applied to a motor of a compressor and a voltage applied to the motor and outputting an integrated stroke value; detecting a mechanical resonance frequency of the compressor based on the integrated stroke value and the current value; determining the mechanical resonance frequency as an operation frequency reference value of the compressor; and varying a current operation frequency of a compressor according to the determined operation frequency reference value.

To achieve the above object, there is also provided an apparatus for controlling an operation of a compressor including: a stroke calculator for calculating a stroke estimate value of a compressor based on a value of a current applied to a motor of the compressor and a value of a voltage applied to the motor of the compressor; an operation frequency reference value determining unit for integrating the current value to output an integrated current value, detecting a mechanical resonance frequency of the compressor based on the stroke estimate value and the integrated current value, and determining the detected mechanical resonance frequency as an operation frequency reference value; and a controller for varying a current operation frequency of the compressor based on the determining the operation frequency reference value.

To achieve the above object, there is also provided an apparatus for controlling an operation of a compressor including: a current detector for detecting a current applied to a motor of a compressor; a voltage detector for detecting a voltage applied to the motor; a stroke calculator for calculating a stroke estimate value of the compressor based on the detected current and voltage values and a parameter of the motor; an operation frequency reference value determining unit for integrating the current value to output an integrated current value, detecting a mechanical resonance frequency of the compressor based on the stroke estimate value and the integrated current value, and determining the detected mechanical resonance frequency as an operation frequency reference value; a comparator for comparing the stroke estimate value outputted from the stroke calculator with a stroke reference value and outputting a difference value according to the comparison result; and a controller for controlling an operation of the compressor by varying a current operation frequency according to the determined operation frequency reference value and varying the voltage applied to the motor of the compressor according to the difference value outputted from the comparator.

To achieve the above object, there is also provided a method for controlling an operation of a compressor including: calculating a stroke estimate value of a compressor based on a value of a current applied to a motor of the compressor and a value of a voltage applied to the motor; integrating the current value to output an integrated current value; detecting a mechanical resonance frequency of the compressor based on the stroke estimate value and the integrated current value; determining the mechanical resonance frequency as an operation frequency reference value of the compressor; and varying a current operation frequency of the compressor according to the determined operation frequency reference value.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

An apparatus and method for controlling an operation of a compressor capable of enhancing operation efficiency of a compressor although a load of the compressor is varied in accordance with preferred embodiments of the present invention will now be described with reference to FIGS. 3 to 8.

Figure 1:
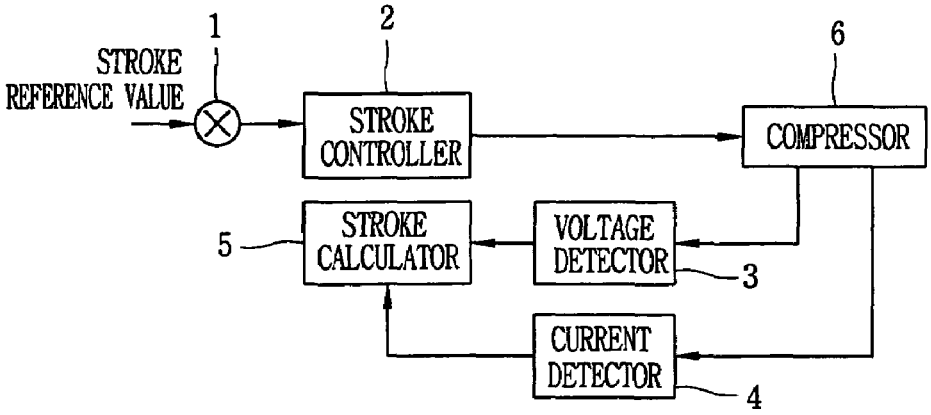
FIG. 1 PRIOR ART
FIG. 1 is a block diagram showing the construction of an apparatus for controlling an operation of a reciprocating compressor in accordance with a prior art.
Figure 2:
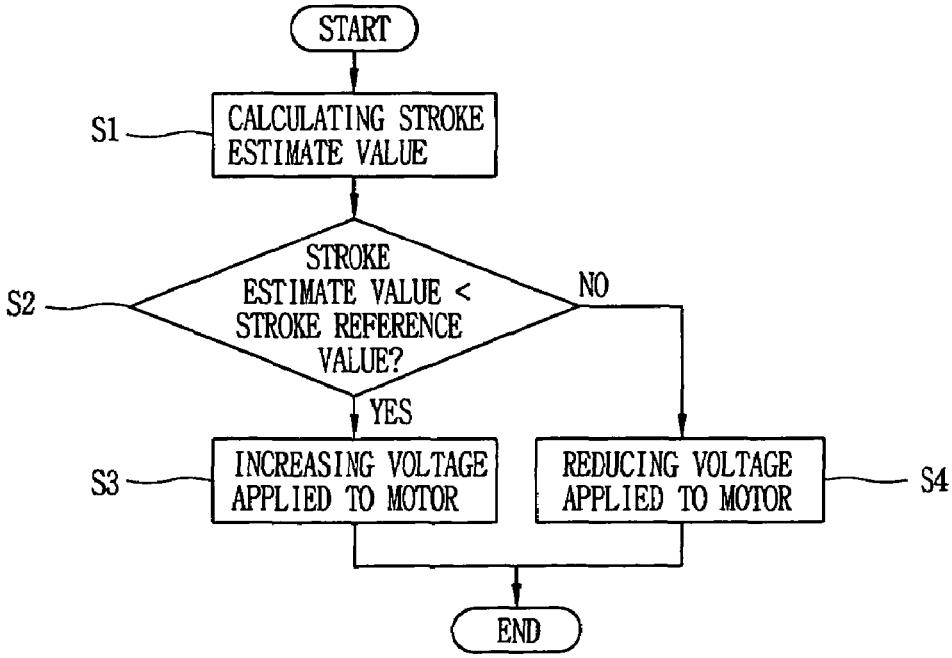
FIG. 2 PRIOR ART
FIG. 2 is a flow chart of a method for controlling an operation of the reciprocating compressor in accordance with the prior art.
Figure 3:
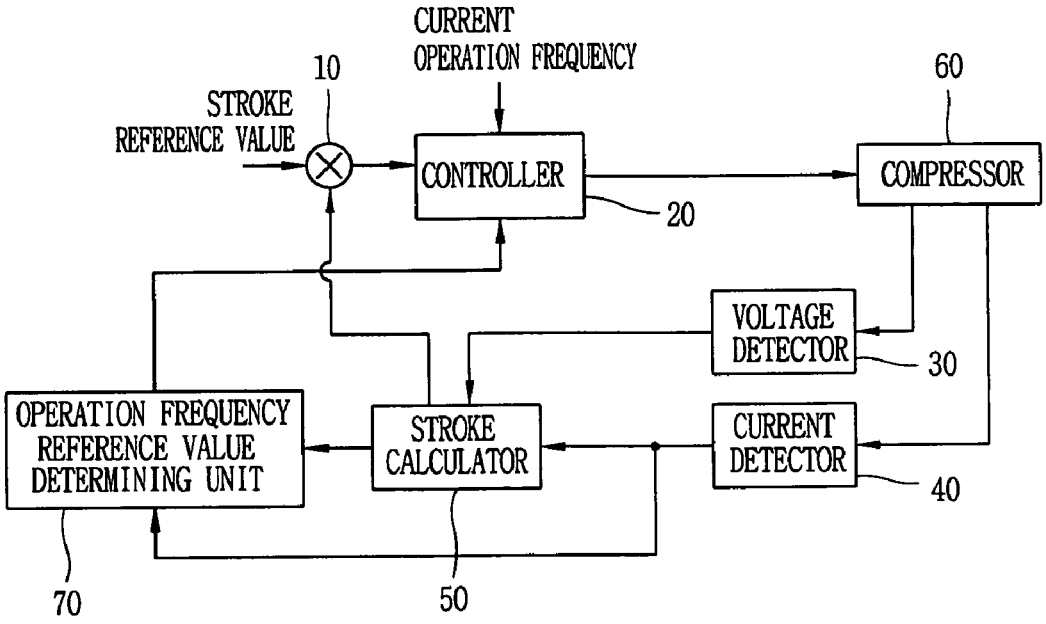
FIG. 3 is a block diagram showing the construction of an apparatus for controlling an operation of a compressor in accordance with a first embodiment of the present invention.

FIG. 3 is a block diagram showing the construction of an apparatus for controlling an operation of a compressor in accordance with a first embodiment of the present invention.

As shown in FIG. 3, an apparatus for controlling an operation of a compressor includes: a current detector 40 for detecting a current applied to a motor of a compressor 60; a voltage detector 30 for detecting a voltage applied to the motor of the compressor 60; a stroke calculator 50 for calculating a stroke estimate value of the compressor 60 based on the detected current and voltage values and a parameter of the motor; an operation frequency reference value determining unit 70 for integrating the stroke estimate value, detecting a mechanical resonance frequency of the compressor based on the integrated stroke estimate value and the detected current value, and determining the detected mechanical resonance frequency as an operation frequency reference value; a comparator 10 for comparing the stroke estimate value outputted from the stroke calculator 50 with a stroke reference value and outputting a difference value according to the comparison result; and a controller 20 for controlling an operation of the compressor 60 by varying a current operation frequency according to the determined operation frequency reference value and varying the voltage applied to the motor of the compressor 60 according to the difference value outputted from the comparator 10.

The operation of the apparatus for controlling an operation of the compressor in accordance with the preferred embodiment of the present invention will be described in detail as follows.

First, the current detector 10 detects a current applied to the compressor 60 and outputs the detected current value to the stroke calculator 50 and the operation frequency reference value determining unit 70. At this time, the voltage detector 30 detects a voltage applied to the compressor 60 and outputs the detected voltage value to the stroke calculator 50.

The stroke calculator 50 calculates a stroke estimate value of the compressor 60 based on the current value outputted from the current detector 40, the voltage value outputted from the voltage detector 30 and a pre-set motor parameter, and then outputs the calculated stroke estimate value to the comparator 10 and the operation frequency reference value determining unit 70.

The comparator 10 compares the stroke reference value with the stroke estimate value outputted from the stroke calculator 50 and then outputs a difference value according to the comparison result to the controller 20.

The controller 20 controls an operation of the compressor 60 by varying the voltage applied to the compressor 60 according to the difference value outputted from the comparator 10.

The operation frequency reference value determining unit 70 integrates the stroke estimate value, detects a mechanical resonance frequency of the compressor based on the integrated stroke estimate value and the current value detected by the current detector 40, and determines the detected mechanical resonance frequency as an operation frequency reference value.

For example, the operation frequency reference value determining unit 70 multiplies integrated stroke values and detected current values during one period when the motor is in a resonant state and determines an operation frequency detected when the sum of the multiplied values becomes zero (0) as an operation frequency reference value. In other words, the operation frequency reference value determining unit 70 recognizes an operation frequency detected when the sum of values obtained by multiplying the integrated stroke values and the detected current values is 0, as a mechanical resonance frequency and determines the mechanical resonance frequency as the operation frequency reference value. Herein, when the operation frequency and the mechanical resonance frequency are identical, operation efficiency of the compressor is enhanced.

The mechanical resonance frequency value is calculated through equation (2) shown below:

$$\Sigma(\int X dt \times i) \quad (2)$$

Namely, the operation frequency reference value determining unit 70 recognizes the operation frequency detected when the value calculated through equation (2) is 0 as the mechanical resonance frequency and determines the mechanical resonance frequency as the operation frequency reference value. Herein, 'X' is a stroke estimate value and 'i' is a value of a current applied to the motor.

Thereafter, the controller 20 controls an operation of the compressor 60 by varying a current operation frequency of the compressor 60 according to the operation frequency reference value outputted from the operation frequency reference value determining unit 70. That is, if the operation frequency reference value is greater than the current operation frequency value, the controller 20 increases the current operation frequency. If the operation frequency reference value is smaller than the current operation frequency value, the controller 20 reduces the current operation frequency.

A stroke phase and a current phase of the compressor will be described with reference to FIGS. 4A and 4B.

Figure 4A:
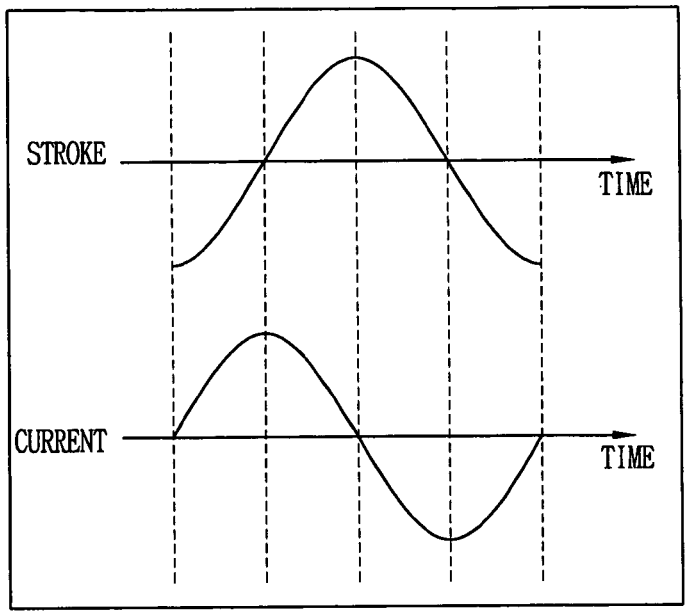
FIGS. 4A and 4B are graphs showing a phase of a current applied to a motor of the compressor and a phase of a stroke of the compressor in accordance with the first embodiment of the present invention.
Figure 4B:
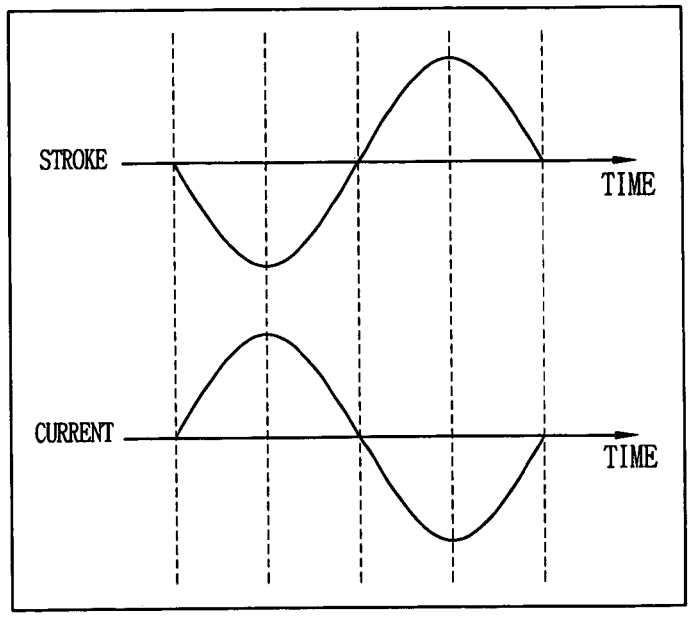

FIGS. 4A and 4B are graphs showing a phase of a current applied to a motor of the compressor and a phase of a stroke of the compressor in accordance with the first embodiment of the present invention, in which the stroke means a position of a piston when the piston of the compressor makes a reciprocal movement and the stroke phase means a waveform (sine wave) according to a position of the piston when the piston makes the reciprocal movement.

As shown in FIG. 4A, a stroke phase and a current phase have the difference of 90°, and in this respect, experimentation reveals that when the stroke phase and the current phase have the difference of 90°, even if a load of the compressor is changed, a resonance phenomenon occurs.

FIG. 4B shows a phase obtained by integrating the stroke phase of FIG. 4A and the current phase.

As shown in FIG. 4B, experimentation reveals that even though the load of the compressor, if the sum of values obtained by multiplying the integrated stroke values and the values of the current applied to the motor is 0, the resonance phenomenon occurs. That is, the integrated stroke values and current values during one period are multiplied when the motor is in the resonant state and then when the multiplied values are added, the added value becomes 0. Accordingly, the operation frequency detected when the sum of values obtained by multiplying the current values and the integrated stroke values is 0, is the same as the mechanical resonance frequency.

The operation of the operation frequency reference value determining unit 70 of multiplying the integrated stroke values and the current values during one period, adding the multiplied values, detecting the operation frequency when the sum is 0, and determining the detected operation frequency value as an operation frequency reference value will be described with reference to FIG. 5 as follows.

Figure 5:
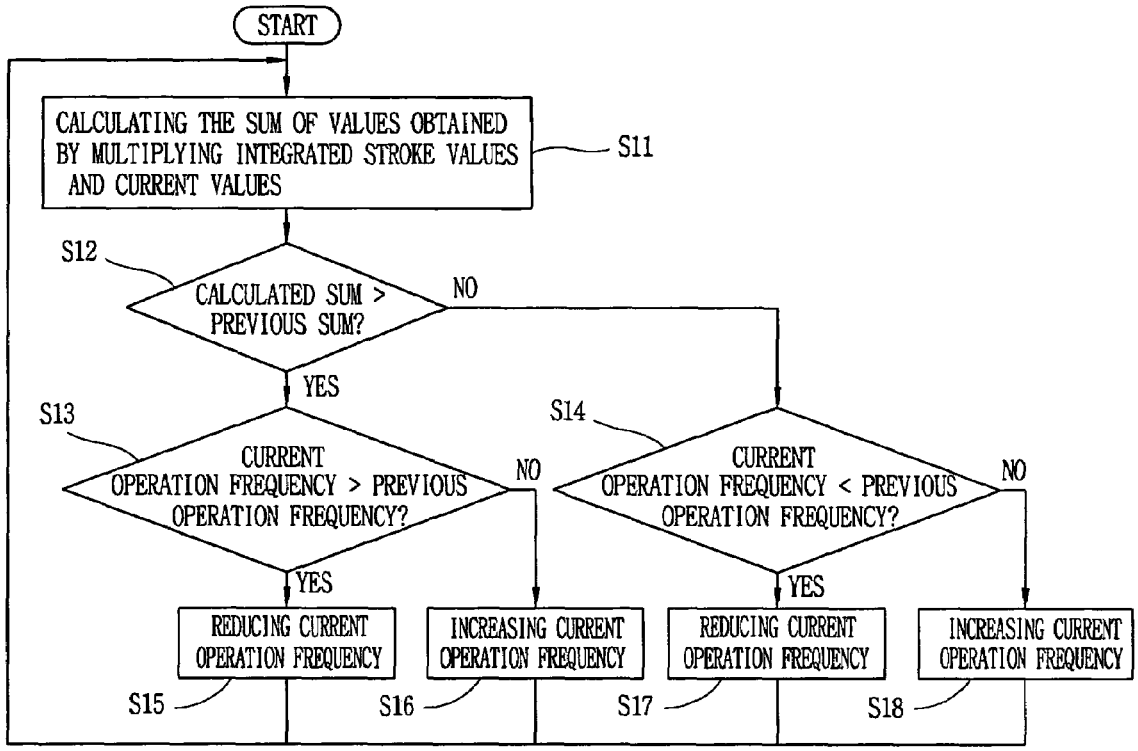
FIG. 5 is a flow chart of a method for controlling an operation of the compressor in accordance with the first embodiment of the present invention.

FIG. 5 is a flow chart of a method for controlling an operation of the compressor in accordance with the first embodiment of the present invention.

As shown in FIG. 5, a method for controlling an operation of the compressor in accordance with the first embodiment of the present invention includes: detecting values of a current and voltage applied to the compressor 60; calculating a stroke estimate value of the compressor based on the current and voltage values; integrating the stroke estimate value to output an integrated stroke estimate value; detecting a mechanical resonance frequency of the compressor based on the sum of values obtained by multiplying the integrated stroke estimate values and the current values during one period and determining the mechanical resonance frequency as an operation frequency reference value; and varying a current operation frequency of the compressor according to the determined operation frequency reference value.

Herein, the operation frequency detected when the sum of values obtained by multiplying the integrated stroke estimate values and the current is values during one period is 0 is the same as the mechanical resonance frequency of the compressor. Accordingly, when the current operation frequency of the compressor is varied according to the operation frequency detected when the sum of values obtained by multiplying the integrated stroke estimate values and the current values during one period is 0, since the varied operation frequency is the same as the mechanical resonance frequency, the operation efficiency of the compressor can be enhanced.

First, the operation frequency reference value determining unit 70 multiples the integrated stroke estimate values and the current values during one period, adds the multiplied values (step S11), and then compares the calculated sum with the sum of values obtained by multiplying integrated stroke values and current values during a previous one period (step S12).

If the sum of the values obtained by multiplying the integrated stroke values and the current values during one period is greater than the sum of values obtained by multiplying the integrated stroke estimate values and the current values during a previous one period and the current operation frequency of the compressor 60 is greater than a previous operation frequency (step S13), the operation frequency reference value determining unit 70 continuously reduces the current operation frequency, and then, determines an operation frequency (identical to the mechanical resonance frequency) detected when the sum of the values obtained by multiplying the integrated stroke estimate values and the current values during one period becomes 0, as an operation frequency reference value (step S15).

If the sum of values obtained by multiplying integrated stroke estimate values and the current values is greater than the sum of values obtained by multiplying the integrated stroke estimate values and the current values during the previous period and if the current operation frequency is smaller than a previous operation frequency (step S13), the operation frequency reference value determining unit 70 continuously increases the current operation frequency, and then, determines an operation frequency detected when the sum of values obtained by multiplying the integrated stroke estimate values and the current values during the current one period is 0 as an operation frequency reference value (step S16).

If the sum of values obtained by multiplying integrated stroke estimate values and the current values is smaller than the sum of values obtained by multiplying the integrated stroke estimate values and the current values during the previous period and if the current operation frequency is smaller than a previous operation frequency (step S14), the operation frequency reference value determining unit 70 continuously reduces the current operation frequency, and then, determines an operation frequency detected when the sum of values obtained by multiplying the integrated stroke estimate values and the current values during the current one period is 0 as an operation frequency reference value (step S17).

Meanwhile, if the sum of values obtained by multiplying integrated stroke estimate values and the current values is smaller than the sum of values obtained by multiplying the integrated stroke estimate values and the current values during the previous period and if the current operation frequency is greater than a previous operation frequency (step S13), the operation frequency reference value determining unit 70 continuously increases the current operation frequency, and then, determines an operation frequency detected when the sum of values obtained by multiplying the integrated stroke estimate values and the current values during the current one period is 0 as an operation frequency reference value (step S18).

Accordingly, since the operation frequency detected when the sum of values obtained by multiplying the integrated stroke estimate values and the current values during one period is 0 is the same as the mechanical resonance frequency of the compressor, the operation efficiency of the compressor can be enhanced by varying the current operation frequency according to the operation frequency detected when the sum of values obtained by multiplying the integrated stroke estimate values and the current values during one period is 0.

In other words, while the reciprocating compressor is operating, whenever a load of the compressor is varied, a mechanical resonance frequency of the compressor is detected based on the integrated stroke estimate values and the current values during one period, and then, the operation frequency of the compressor is varied according to the detected mechanical resonance frequency, thereby enhancing the operation efficiency of the compressor.

On the other hand, in the present invention, after the current applied to the motor is integrated, the mechanical resonance frequency of the compressor can be detected based on the integrated current value and the stroke estimate value.

Accordingly, the second embodiment of the present invention capable of enhancing operation efficiency of the compressor by detecting the mechanical resonance frequency of the compressor based on the integrated current value and the stroke estimate value and varying the operation frequency of the compressor according to the detected mechanical resonance frequency, will now be described with reference to FIGS. 6 to 8.

The construction of the apparatus for controlling an operation of the compressor in accordance with the second embodiment of the present invention is the same as the first embodiment except for an operation frequency reference value determining unit 100, and thus, the same reference numerals are give to the same elements.

Figure 6:
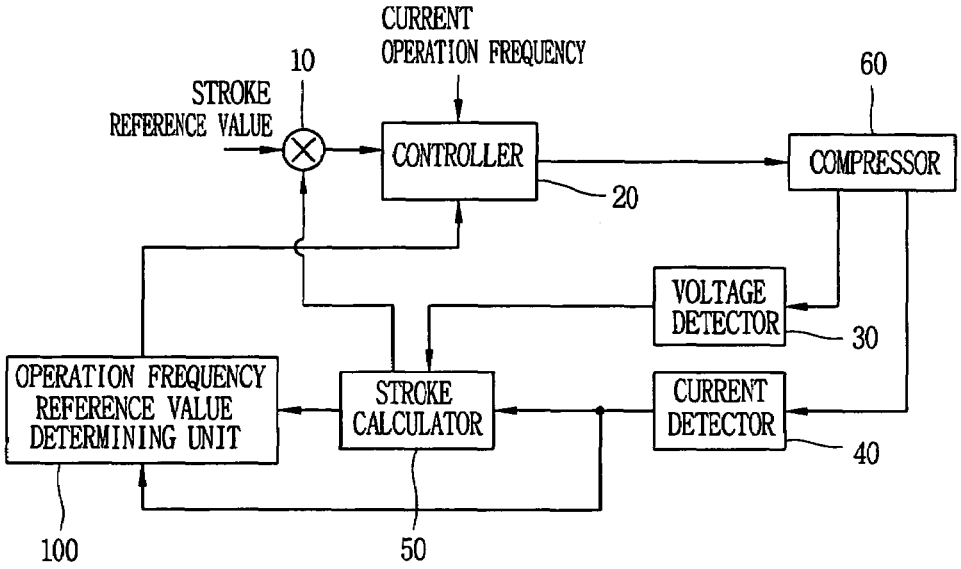
FIG. 6 is a block diagram showing an apparatus for controlling an operation of a compressor in accordance with a second embodiment of the present invention.

FIG. 6 is a block diagram showing an apparatus for controlling an operation of a compressor in accordance with a second embodiment of the present invention.

As shown in FIG. 6, the apparatus for controlling an operation of the reciprocating compressor in accordance with the second embodiment of the present invention includes: a current detector 40 for detecting a current applied to a motor of a compressor 60; a voltage detector 30 for detecting a voltage applied to the motor of the compressor 60; a stroke calculator 50 for calculating a stroke estimate value of the compressor 60 based on the detected current and voltage values and a parameter of the motor; an operation frequency reference value determining unit 100 for integrating the detected current value, detecting a mechanical resonance frequency of the compressor based on the integrated current value and the detected stroke estimate value, and determining the detected mechanical resonance frequency as an operation frequency reference value; a comparator 10 for comparing the stroke estimate value outputted from the stroke calculator 50 with a stroke reference value and outputting a difference value according to the comparison result; and a controller 20 for controlling an operation of the compressor 60 by varying a current operation frequency according to the determined operation frequency reference value and varying the voltage applied to the motor of the compressor 60 according to the difference value outputted from the comparator 10.

The operation of the apparatus for controlling an operation of the compressor in accordance with the second embodiment of the present invention will be described in detail as follows.

First, the current detector 10 detects a current applied to the compressor 60 and outputs the detected current value to the stroke calculator 50 and the operation frequency reference value determining unit 100. At this time, the voltage detector 30 detects a voltage applied to the compressor 60 and outputs the detected voltage value to the stroke calculator 50.

The stroke calculator 50 calculates a stroke estimate value of the compressor 60 based on the current value outputted from the current detector 40, the voltage value outputted from the voltage detector 30 and a pre-set motor parameter, and then outputs the calculated stroke estimate value to the comparator 10 and the operation frequency reference value determining unit 100.

The comparator 10 compares the stroke reference value with the stroke estimate value outputted from the stroke calculator 50 and then outputs a difference value according to the comparison result to the controller 20.

The controller 20 controls an operation of the compressor 60 by varying the voltage applied to the compressor 60 according to the difference value outputted from the comparator 10.

The operation frequency reference value determining unit 100 integrates the detected current value, detects a mechanical resonance frequency of the compressor based on the integrated current value and the stroke estimate value, and determines the detected mechanical resonance frequency as an operation frequency reference value.

For example, the operation frequency reference value determining unit 100 multiplies integrated current values and stroke estimate values during one period when the motor is in a resonant state and determines an operation frequency detected when the sum of the multiplied values becomes the maximum as an operation frequency reference value. In other words, the operation frequency reference value determining unit 100 recognizes an operation frequency detected when the sum of values obtained by multiplying the integrated current values and the stroke estimate values becomes the maximum, as a mechanical resonance frequency and determines the mechanical resonance frequency as the operation frequency reference value. Herein, when the operation frequency and the mechanical resonance frequency are the same, operation efficiency of the compressor is enhanced.

The mechanical resonance frequency value is calculated through equation (3) shown below:

$$\Sigma(X \times \int i dt) \quad (3)$$

Namely, the operation frequency reference value determining unit 100 recognizes the operation frequency detected when the value calculated through equation (3) is maximized as the mechanical resonance frequency and determines the mechanical resonance frequency as the operation frequency reference value. Herein, 'X' is a stroke estimate value and 'i' is a value of a current applied to the motor.

Thereafter, the controller 20 controls an operation of the compressor 60 by varying a current operation frequency of the compressor 60 according to the operation frequency reference value outputted from the operation frequency reference value determining unit 100. That is, if the operation frequency reference value is greater than the current operation frequency value, the controller 20 increases the current operation frequency. If the operation frequency reference value is smaller than the current operation frequency value, the controller 20 reduces the current operation frequency.

A stroke phase and a current phase of the compressor will be described with reference to FIG. 7.

Figure 7:
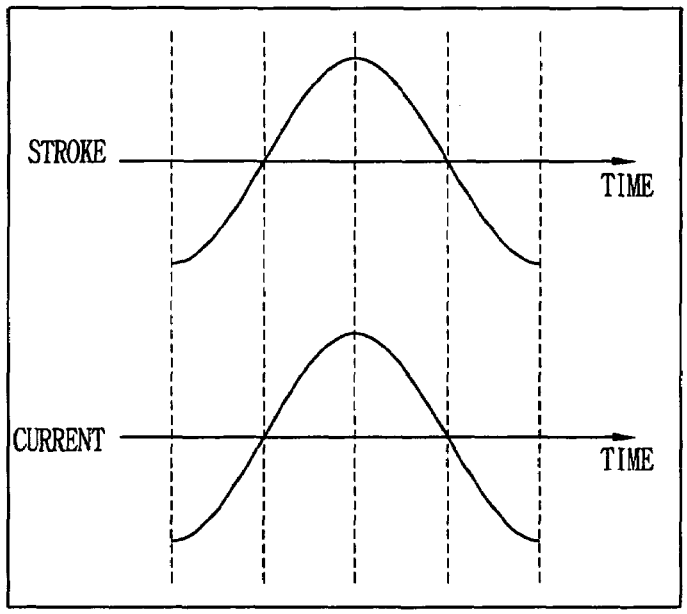
FIG. 7 is a graph showing a phase of a current applied to a motor of the compressor and a phase of a stroke of the compressor in accordance with the second embodiment of the present invention.

FIG. 7 is a graph showing a phase of a current applied to a motor of the compressor and a phase of a stroke of the compressor in accordance with the second embodiment of the present invention. Namely, FIG. 7 shows a phase obtained by integrating the current phase of FIG. 4A and the stroke phase.

As shown in FIG. 7, experimentation reveals that even though the load of the compressor, when the sum of values obtained by multiplying the stroke estimate values and the integrated current values becomes the maximum, the resonance phenomenon occurs. That is, the integrated current values and the stroke estimate values during one period are multiplied when the motor is in the resonant state, and then when the multiplied values are added, the added value becomes the maximum. Accordingly, the operation frequency detected when the sum of values obtained by multiplying the integrated current values and the stroke estimate values becomes the maximum, is the same as the mechanical resonance frequency.

The operation of the operation frequency reference value determining unit 100 of multiplying the integrated stroke values and the current values during one period, adding the multiplied values, detecting the operation frequency when the sum is the maximum, and determining the detected operation frequency value as an operation frequency reference value will be described with reference to FIG. 5 as follows.

Figure 8:
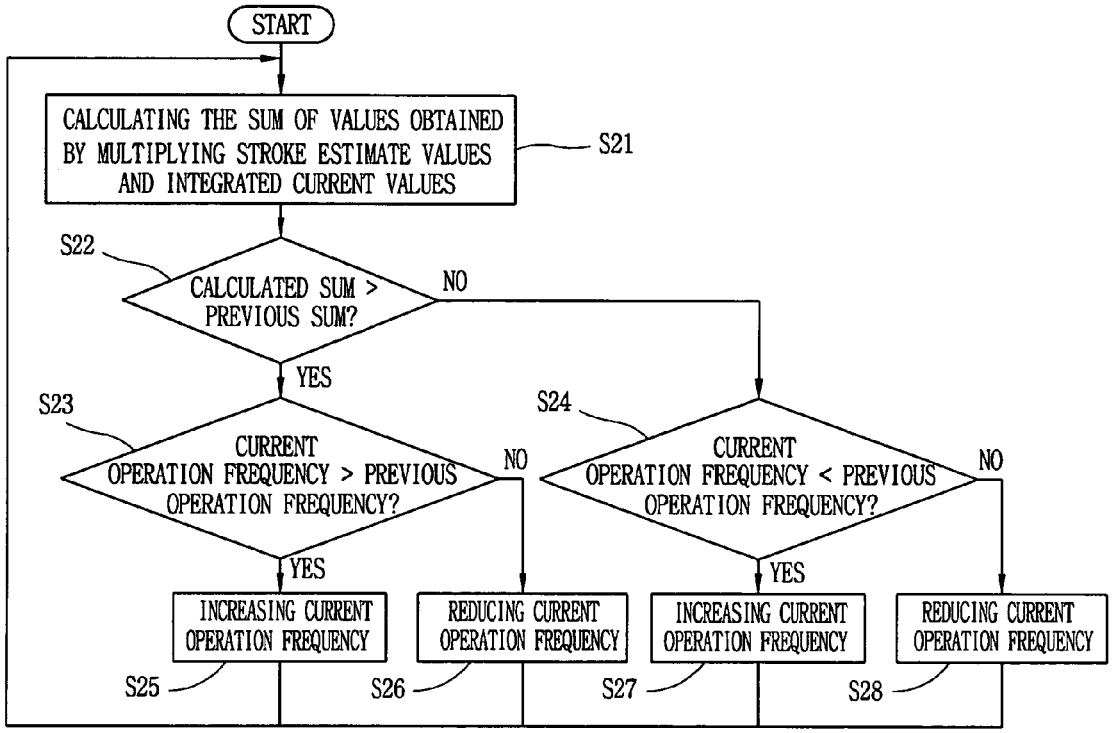
FIG. 8 is a flow chart of a method for controlling an operation of the compressor in accordance with the second embodiment of the present invention.

FIG. 8 is a flow chart of a method for controlling an operation of the compressor in accordance with the second embodiment of the present invention.

As shown in FIG. 8, a method for controlling an operation of the compressor in accordance with the second embodiment of the present invention includes: detecting values of a current and voltage applied to the compressor 60; calculating a stroke estimate value of the compressor based on the current and voltage values; integrating the stroke estimate value to output an integrated stroke estimate value; detecting a mechanical resonance frequency of the compressor based on the sum of values obtained by multiplying the stroke estimate values and integrated current values during one period and determining the mechanical resonance frequency as an operation frequency reference value; and varying a current operation frequency of the compressor according to the determined operation frequency reference value.

Herein, the operation frequency detected when the sum of values obtained by multiplying the integrated stroke estimate values and the current values during one period is the maximum is the same as the mechanical resonance frequency of the compressor. Accordingly, when the current operation frequency of the compressor is varied according to the operation frequency detected when the sum of values obtained by multiplying the stroke estimate values and the integrated current values during one period is the maximum, because the varied operation frequency is the same as the mechanical resonance frequency, the operation efficiency of the compressor can be enhanced.

First, the operation frequency reference value determining unit 100 multiples the stroke estimate values and the integrated current values during one period, adds the multiplied values (step S21), and then compares the calculated sum with the sum of values obtained by multiplying stroke estimate values and integrated current values during a previous one period (step S22).

If the sum of the values obtained by multiplying the stroke estimate values and the integrated current values during one period is greater than the sum of values obtained by multiplying the stroke estimate values and the integrated current values during a previous one period and the current operation frequency of the compressor 60 is greater than a previous operation frequency (step S23), the operation frequency reference value determining unit 100 continuously increases the current operation frequency, and then, determines an operation frequency (the same as the mechanical resonance frequency) detected when the sum of the values obtained by multiplying the stroke estimate values and the integrated current values during one period becomes the maximum, as an operation frequency reference value (step S25).

If the sum of the values obtained by multiplying the stroke estimate values and the integrated current values during one period is greater than the sum of values obtained by multiplying the stroke estimate values and the integrated current values during a previous one period and the current operation frequency of the compressor 60 is smaller than a previous operation frequency (step S23), the operation frequency reference value determining unit 100 continuously reduces the current operation frequency, and then, determines an operation frequency detected when the sum of the values obtained by multiplying the stroke estimate values and the integrated current values during a current one period becomes the maximum, as an operation frequency reference value (step S26).

If the sum of the values obtained by multiplying the stroke estimate values and the integrated current values during one period is smaller than the sum of values obtained by multiplying the stroke estimate values and the integrated current values during a previous one period and the current operation frequency of the compressor 60 is smaller than a previous operation frequency (step S24), the operation frequency reference value determining unit 100 continuously increases the current operation frequency, and then, determines an operation frequency detected when the sum of the values obtained by multiplying the stroke estimate values and the integrated current values during a current one period becomes the maximum, as an operation frequency reference value (step S27).

If the sum of the values obtained by multiplying the stroke estimate values and the integrated current values during one period is smaller than the sum of values obtained by multiplying the stroke estimate values and the integrated current values during a previous one period and the current operation frequency of the compressor 60 is greater than a previous operation frequency (step S24), the operation frequency reference value determining unit 100 continuously reduces the current operation frequency, and then, determines an operation frequency detected when the sum of the values obtained by multiplying the stroke estimate values and the integrated current values during a current one period becomes the maximum, as an operation frequency reference value (step S28).

Accordingly, since the operation frequency detected when the sum of values obtained by multiplying the stroke estimate values and the integrated current values during one period becomes the maximum is the same as the mechanical resonance frequency of the compressor, the operation efficiency of the compressor can be enhanced by varying the current operation frequency according to the operation frequency detected when the sum of values obtained by multiplying the stroke estimate values and the integrated current values during one period becomes the maximum.

In other words, while the reciprocating compressor is operating, whenever a load of the compressor is varied, a mechanical resonance frequency of the compressor is detected based on the stroke estimate values and the integrated current values during one period, and then, the operation frequency of the compressor is varied according to the detected mechanical resonance frequency, thereby enhancing the operation efficiency of the compressor.

As so far described, the apparatus and method for controlling an operation of a reciprocating compressor in accordance with the present invention have the following advantages.

That is, for example, whenever a load of the compressor is varied, a mechanical resonance frequency of ht compressor is detected based on integrated stroke values and current values during one period and an operation frequency of the compressor is varied according to the detected mechanical resonance frequency. Thus, even when the load of the compressor is varied, the operation efficiency of the compressor can be enhanced.

In addition, whenever a load of the compressor is varied, a mechanical resonance frequency of ht compressor is detected based on stroke values and integrated current values during one period and an operation frequency of the compressor is varied according to the detected mechanical resonance frequency. Thus, even when the load of the compressor is varied, the operation efficiency of the compressor can be also enhanced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling a compressor comprising:

a stroke calculator for calculating a stroke estimate value of a compressor based on a value of a current applied to a motor of the compressor and a value of a voltage applied to the motor of the compressor;

an operation frequency reference determining unit for integrating the stroke estimate value to output an integrated stroke value, detecting a mechanical resonance frequency of the compressor based on the integrated stroke estimate value and the current value, and determining the detected mechanical resonance frequency as an operation frequency reference value, wherein the operation frequency reference value determining unit multiplies the integrated stroke values and current values during one time period, and determines an operation frequency of the compressor detected when the sum of the multiplied values is 0 as the operation frequency reference value; and a controller for varying a current operation frequency of the compressor according to the determined operation frequency reference value.

2. The apparatus of claim 1, wherein the operation frequency detected when the sum of the multiplied values is 0 is identical to the mechanical resonance frequency of the compressor.

3. The apparatus of claim 1, wherein the operation frequency reference value is an operation frequency value detected when a value calculated through equation $\Sigma(\int X dt \times i)$ is 0, wherein 'X' is the stroke estimate value and 'i' is the value of the current applied to the motor.

4. The apparatus of claim 1, wherein if a sum of the values obtained by multiplying the integrated stroke values and the current values during one time period is greater than a previous sum of values obtained by multiplying the integrated stroke estimate values and the current values during a previous one time period and the current operation frequency is greater than a previous operation frequency, then the operation frequency reference value determining unit continuously reduces the current operation frequency, and then, determines the operation frequency detected when the sum of the values obtained by multiplying the integrated stroke estimate values and the current values during a current one time period becomes 0, as the operation frequency reference value.

5. The apparatus of claim 1, wherein if a sum of values obtained by multiplying integrated stroke estimate values and the current values is greater than a previous sum of values obtained by multiplying the integrated stroke estimate values and the current values during a previous time period and the current operation frequency is smaller than a previous operation frequency, then the operation frequency reference value determining unit continuously increases the current operation frequency, and then, determines the operation frequency detected when the sum of values obtained by multiplying the integrated stroke estimate values and the current values during the current one time period is 0 as the operation frequency reference value.

6. The apparatus of claim 1, wherein if a sum of values obtained by multiplying integrated stroke estimate values and the current values is smaller than a previous sum of values obtained by multiplying the integrated stroke estimate values and the current values during a previous time period and the current operation frequency is smaller than a previous operation frequency, then the operation frequency reference value determining unit continuously reduces the current operation frequency, and then, determines the operation frequency detected when the sum of values obtained by multiplying the integrated stroke estimate values and the current values during the current one time period is 0 as the operation frequency reference value.

7. The apparatus of claim 1, wherein if a sum of values obtained by multiplying integrated stroke estimate values and the current values is smaller than a previous sum of values obtained by multiplying the integrated stroke estimate values and the current values during a previous time period and the current operation frequency is greater than a previous operation frequency, then the operation frequency reference value determining unit continuously increases the current operation frequency, and then, determines the operation frequency detected when the sum of values obtained by multiplying the integrated stroke estimate values and the current values during the current one time period is 0 as the operation frequency reference value.

8. An apparatus for controlling an operation of a compressor comprising:

a current detector for detecting a current applied to a motor of the compressor;

a voltage detector for detecting a voltage applied to the motor;

a stroke calculator for calculating a stroke estimate value of the compressor based on the detected current and voltage values and a parameter of the motor;

an operation frequency reference value determining unit for integrating the stroke estimate value to output an integrated stroke value, detecting a mechanical resonance frequency of the compressor based on the integrated stroke estimate value and the detected current value, and determining the detected mechanical resonance frequency as an operation frequency reference value, wherein the operation frequency reference value determining unit multiplies the integrated stroke values and current values during one time period, and determines an operation frequency of the compressor detected when the sum of the multiplied values is 0 as the operation frequency reference value;

a comparator for comparing the stroke estimate value outputted from the stroke calculator with a stoke reference value and outputting a difference value according to the comparison result; and a controller for controlling an operation of the compressor by varying a current operation frequency according to the determined operation frequency reference value and varying the voltage applied to the motor of the compressor according to the difference value outputted from the comparator.

9. A method for controlling an operation of a compressor comprising:

integrating a stroke estimate value of the compressor based on a value of a current applied to a motor of the compressor and a voltage applied to the motor and outputting an integrated stroke value;

detecting a mechanical resonance frequency of the compressor based on the integrated stroke estimate value and the current value;

determining the mechanical resonance frequency as an operation frequency reference value of the compressor; and varying a current operation frequency of a compressor according to the determined operation frequency reference value, wherein the step of determining the mechanical resonance frequency as an operation frequency reference value of the compressor comprises multiplying the integrated stroke values and current values during one time period, and determining an operation frequency of the compressor detected when the sum of the multiplied values is 0 as the operation frequency reference value.

10. The method according to claim 9, wherein the operation frequency reference value is an operation frequency value detected when a value calculated through equation $\Sigma(\int X dt \times i)$ is 0, wherein 'X' is the stroke estimate value and 'i' is the value of the current applied to the motor.

11. The method of claim 9, wherein the step of determining the mechanical resonance frequency as the operation frequency reference value comprises:

a step in which if a sum of the values obtained by multiplying the integrated stroke values and the current values during one time period is greater than a previous sum of values obtained by multiplying the integrated stroke estimate values and the current values during a previous one time period and the current operation frequency of the compressor is greater than a previous operation frequency, then the current operation frequency is continuously reduced and the operation frequency detected when the sum of the values obtained by multiplying the integrated stroke estimate values and the current values during a current one time period becomes 0, is determined as the operation frequency reference value;

a step in which if the sum of values obtained by multiplying integrated stroke estimate values and the current values is greater than the sum of values obtained by multiplying the integrated stroke estimate values and the current values during the previous time period and the current operation frequency is smaller than a previous operation frequency, the current operation frequency is continuously increased and the operation frequency detected when the sum of values obtained by multiplying the integrated stroke estimate values and the current values during the current one time period is 0 is determined as the operation frequency reference value;

a step in which if the sum of values obtained by multiplying integrated stroke estimate values and the current values is smaller than the sum of values obtained by multiplying the integrated stroke estimate values and the current values during the previous time period and the current operation frequency is smaller than a previous operation frequency, the current operation frequency is continuously reduced and the operation frequency detected when the sum of values obtained by multiplying the integrated stroke estimate values and the current values during the current one time period is 0 is determined as the operation frequency reference value; and a step in which if the sum of values obtained by multiplying integrated stroke estimate values and the current values is smaller than the sum of values obtained by multiplying the integrated stroke estimate values and the current values during the previous time period and the current operation frequency is greater than a previous operation frequency, the current operation frequency is continuously increased and the operation frequency detected when the sum of values obtained by multiplying the integrated stroke estimate values and the current values during the current one time period is 0 is determined as the operation frequency reference value.

12. An apparatus for controlling an operation of a compressor comprising:

a stroke calculator for calculating a stroke estimate value of the compressor based on a value of a current applied to a motor of the compressor and a value of a voltage applied to the motor of the compressor;

an operation frequency reference value determining unit for integrating the current value to output an integrated current value, detecting a mechanical resonance frequency of the compressor based on the stroke estimate value and the integrated current value, and determining the detected mechanical resonance frequency as an operation frequency reference value, wherein the operation frequency reference value determining unit multiplies the stroke estimate values and integrated current values during one time period, and determines an operation frequency of the compressor detected when the sum of the multiplied values becomes the maximum as the operation frequency reference value; and a controller for varying a current operation frequency of the compressor based on the determining the operation frequency reference value.

13. The apparatus of claim 12, wherein the operation frequency detected when the sum of the multiplied values is the maximum is identical to the mechanical resonance frequency of the compressor.

14. The apparatus of claim 12, wherein the operation frequency reference value is an operation frequency value detected when a value calculated through equation $\Sigma(X\times\int idt)$ is the maximum, wherein 'X' is the stroke estimate value and 'i' is the value of the current applied to the motor.

15. The apparatus of claim 12, wherein if a sum of the values obtained by multiplying the stroke estimate values and the integrated current values during one time period is greater than a previous sum of values obtained by multiplying the stroke estimate values and the integrated current values during a previous one time period and the current operation frequency of the compressor is greater than a previous operation frequency, then the operation frequency reference value determining unit continuously increases the current operation frequency, and then, determines the operation frequency detected when the sum of the values obtained by multiplying the stroke estimate values and the integrated current values during one time period becomes the maximum as the operation frequency reference value.

16. The apparatus of claim 12, wherein if a sum of the values obtained by multiplying the stroke estimate values and the integrated current values during one time period is greater than a previous sum of values obtained by multiplying the stroke estimate values and the integrated current values during a previous one time period and the current operation frequency of the compressor is smaller than a previous operation frequency, then the operation frequency reference value determining unit continuously reduces the current operation frequency, and then, determines the operation frequency detected when the sum of the values obtained by multiplying the stroke estimate values and the integrated current values during a current one time period becomes the maximum as the operation frequency reference value.

17. The apparatus of claim 12, wherein if a sum of the values obtained by multiplying the stroke estimate values and the integrated current values during one time period is smaller than a previous sum of values obtained by multiplying the stroke estimate values and the integrated current values during a previous one time period and the current operation frequency of the compressor is smaller than a previous operation frequency, then the operation frequency reference value determining unit continuously increases the current operation frequency, and then, determines the operation frequency detected when the sum of the values obtained by multiplying the stroke estimate values and the integrated current values during a current one time period becomes the maximum as the operation frequency reference value.

18. The apparatus of claim 12, wherein if a sum of the values obtained by multiplying the stroke estimate values and the integrated current values during one time period is smaller than a previous sum of values obtained by multiplying the stroke estimate values and the integrated current values during a previous one time period and the current operation frequency of the compressor is greater than a previous operation frequency, then the operation frequency reference value determining unit continuously reduces the current operation frequency, and then, determines the operation frequency detected when the sum of the values obtained by multiplying the stroke estimate values and the integrated current values during a current one time period becomes the maximum as the operation frequency reference value.

19. An apparatus for controlling an operation of a compressor comprising:

a current detector for detecting a current applied to a motor of the compressor;

a voltage detector for detecting a voltage applied to the motor;

a stroke calculator for calculating a stroke estimate value of the compressor based on the detected current and voltage values and a parameter of the motor;

an operation frequency reference value determining unit for integrating the current value to output an integrated current value, detecting a mechanical resonance frequency of the compressor based on the stroke estimate value and the integrated current value, and determining the detected mechanical resonance frequency as an operation frequency reference value, wherein the operation frequency reference value determining unit multiplies the stroke estimate values and integrated current values during one time period, and determines an operation frequency of the compressor detected when the sum of the multiplied values becomes the maximum as the operation frequency reference value;

a comparator for comparing the stroke estimate value outputted from the stroke calculator with a stroke reference value and outputting a difference value according to the comparison result; and a controller for controlling an operation of the compressor by varying a current operation frequency according to the determined operation frequency reference value and varying the voltage applied to the motor of the compressor according to the difference value outputted from the comparator.

20. A method for controlling an operation of a compressor comprising:

calculating a stroke estimate value of the compressor based on a value of a current applied to a motor of the compressor and a value of a voltage applied to the motor;

integrating the current value to output an integrated current value;

detecting a mechanical resonance frequency of the compressor based on the stroke estimate value and the integrated current value; and determining the mechanical resonance frequency as an operation frequency reference value of the compressor; and varying a current operation frequency of the compressor according to the determined operation frequency reference value, wherein the step of determining the mechanical resonance frequency as an operation frequency reference value of the compressor comprises multiplying the stroke estimate values and integrated current values during one time period, and determining an operation frequency of the compressor detected when the sum of the multiplied values becomes the maximum as the operation frequency reference value.

21. The method of claim 20, wherein the step of determining the mechanical resonance frequency as the operation frequency reference value comprises:

a step in which if a sum of the values obtained by multiplying the stroke estimate values and the integrated current values during one time period is greater than a previous sum of values obtained by multiplying the stroke estimate values and the integrated current values during a previous one time period and the current operation frequency of the compressor is greater than a previous operation frequency, then the current operation frequency is continuously increased and the operation frequency detected when the sum of the values obtained by multiplying the stroke estimate values and the integrated current values during one time period becomes the maximum is determined as the operation frequency reference value;

a step in which if the sum of the values obtained by multiplying the stroke estimate values and the integrated current values during one time period is greater than the sum of values obtained by multiplying the stroke estimate values and the integrated current values during a previous one time period and the current operation frequency of the compressor is smaller than a previous operation frequency, then the current operation frequency is continuously reduced and the operation frequency detected when the sum of the values obtained by multiplying the stroke estimate values and the integrated current values during a current one time period becomes the maximum is determined as the operation frequency reference value;

a step in which if the sum of the values obtained by multiplying the stroke estimate values and the integrated current values during one time period is smaller than the sum of values obtained by multiplying the stroke estimate values and the integrated current values during a previous one time period and the current operation frequency of the compressor is smaller than a previous operation frequency, then the current operation frequency is continuously increased and the operation frequency detected when the sum of the values obtained by multiplying the stroke estimate values and the integrated current values during a current one time period becomes the maximum is determined as the operation frequency reference value; and a step in which if the sum of the values obtained by multiplying the stroke estimate values and the integrated current values during one time period is smaller than the sum of values obtained by multiplying the stroke estimate values and the integrated current values during a previous one time period and the current operation frequency of the compressor is greater than a previous operation frequency, then the current operation frequency is continuously reduced and the operation frequency detected when the sum of the values obtained by multiplying the stroke estimate values and the integrated current values during a current one time period becomes the maximum is determined as the operation frequency reference value.

* * * * *